United States Patent [19]

Malone

[11] Patent Number: 4,533,160

[45] Date of Patent: Aug. 6, 1985

[54] GENERAL JOURNAL FORM

[76] Inventor: Harold H. Malone, 3900 E. Waterman, Wichita, Kans. 67218

[21] Appl. No.: 447,281

[22] Filed: Dec. 6, 1982

[51] Int. Cl.[3] ..... B41L 1/24; B41L 1/20; B41L 3/00

[52] U.S. Cl. ..... 282/23 R; 282/8 R; 282/9 R

[58] Field of Search ..... 282/8 R, 9 R, 9 A, 11 R, 282/23 R

[56] References Cited

U.S. PATENT DOCUMENTS

| | | | |
|---|---|---|---|
| 2,507,307 | 5/1950 | Josephy | 282/9 R |
| 2,757,940 | 8/1956 | Moss | 282/23 R |
| 2,962,302 | 11/1960 | Layton | 282/23 R |
| 3,116,941 | 1/1964 | Malone | 282/23 R |
| 3,257,129 | 6/1966 | Malone | 282/23 R |
| 4,153,277 | 5/1979 | Bellanca | 282/8 R |
| 4,179,139 | 12/1979 | Sauar et al. | 282/23 R |
| 4,191,402 | 3/1980 | Michlin | 282/23 R |

*Primary Examiner*—Paul A. Bell
*Assistant Examiner*—Paul M. Heyrana
*Attorney, Agent, or Firm*—John H. Widdowson

[57] ABSTRACT

A general journal form having a top record leaf, a pressure sensitive self-contained leaf, a carbon leaf and a back record leaf. All leaves are bound together as pages of a book at a common border. The top record leaf, the pressure sensitive leaf, and the back record leaf have identical printed matter and lines in overlying registry for record keeping purpose. The printed matter and lines extend transversly across each of the leaves. The identical printed matter and lines also are repeated on the top record leaf, the pressure sensitive leaf, and the back record leaf at equally spaced intervals a plurality of times from the upper to the lower portion of each of the three leaves. Parallel rows of perforations extend transversly across the entire width of the top record leaf and the back record leaf contiguous to the upper extremities of each of the equally spaced repetitive printed matter on each of the two leaves.

1 Claim, 7 Drawing Figures

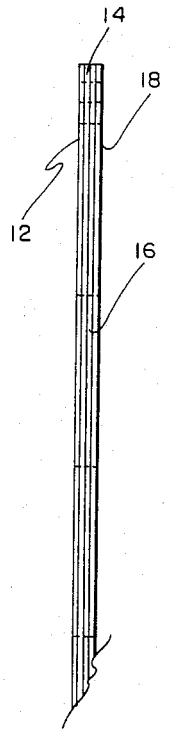
FIG. 4
FIG. 5
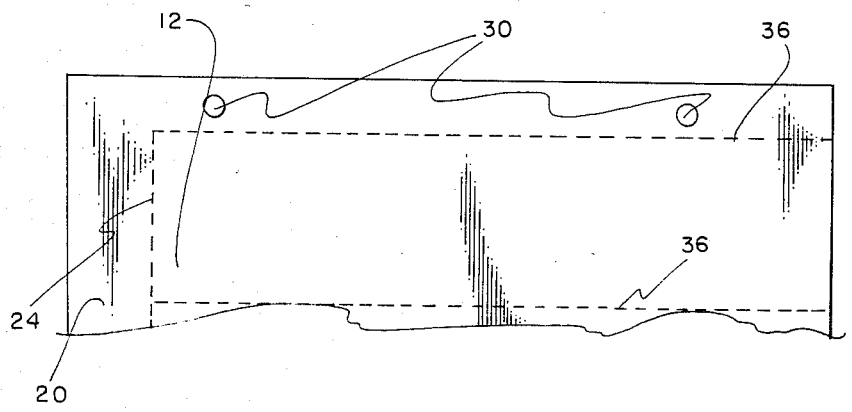
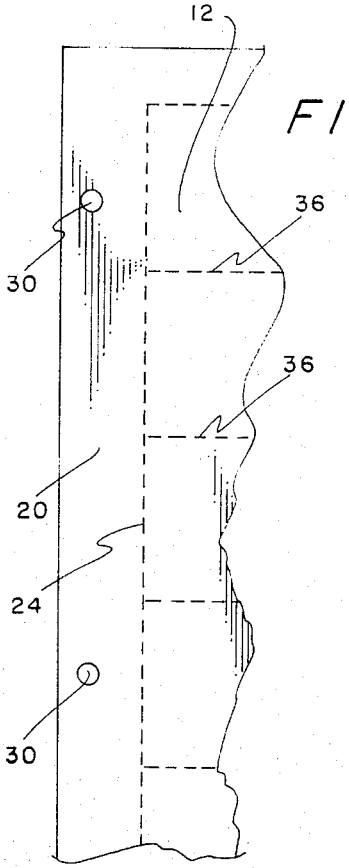
FIG. 6
FIG. 7
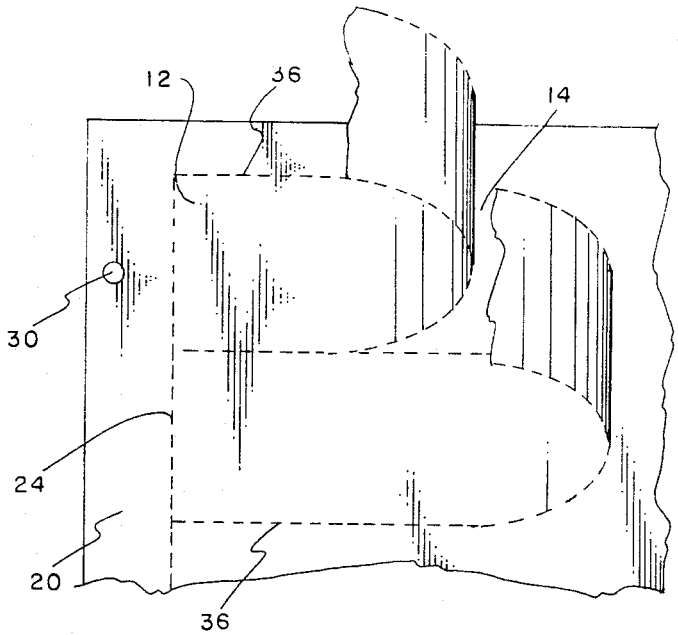

GENERAL JOURNAL FORM

BACKGROUND OF THE INVENTION

1. Field of the Invention

This invention is related to a bookkeeping form. More specifically, this invention provides a general journal form.

2. Description of the Prior Art

U.S. Pat. No. 2,668,065 by English et al disclose an accounting form wherein the same has a face sheet divided into a plurality of record keeping sections but is not perforated for separation. U.S. Pat. No. 4,153,277 by Bellanca illustrates a record keeping system having a multiple sheet assembly including a label with adhesive backing and an adhesive backed flap for registration. There is a master ledger sheet for recording a plurality of entries whereby securing the flap of the assembly to the back of the master ledger sheet allows proper registration so indicia on the label assembly will be transferred to the master ledger sheet. U.S. Pat. No. 3,233,918 by Tathwell discloses an accounting form wherein a stack of sheets may be arranged in proper registration so that information applied to the master sheets is transferred to the underlying sheets. U.S. Pat. No. 3,353,845 by Curran teaches a shipping label wherein the same is comprised of a plurality of separable sheets wherein transfer of information on the front sheet is applied to an underlying sheet which may be adhesively secured to a base or package. None of the foregoing prior art teach or suggest the particular general journal form of this invention.

SUMMARY OF THE INVENTION

It is therefore an object of this invention to provide a general journal form for general journal and general ledger debit and credit entries with only one writing.

Still other objects will be apparent to those skilled in the art from the following description of this invention.

The foregoing objects are achieved according to the practice of this invention. Broadly, this invention comprises a general journal form including, in combination, a top record leaf; a pressure sensitive self-contained leaf; transfer means; and a back record leaf, all bound together as pages of a book, in order stated, at a common border. The top record leaf, the pressure sensitive self-contained leaf, and the back record leaf all have identical printed matter and lines in overlying registry for record keeping purposes extending transversely across each of the leaves. The identical printed matter and lines are repeated on the top record leaf, the pressure sensitive self-contained leaf, and the back record leaf at equally spaced intervals a plurality of times from the upper to the lower portion of each of the three leaves. Parallel rows of perforation extend transversely across the entire width of the top record leaf and the back record leaf contiguous to the upper extremities of each of the equally spaced repetitive printed matter on the top record leaf and on the back record leaf.

BRIEF DESCRIPTION OF THE DRAWINGS

FIG. 4 is a side elevational view of the general journal form;

FIG. 5 is a partial top plan view of the general journal form disclosing apertures at the top thereof for a ring binder;

FIG. 6 is a partial top plan view of the general journal form disclosing apertures on the border of the general journal form for another ring binder; and FIG. 7 is a partial top plan view of the general journal form disclosing segments of the top record leaf being removed along the perforated lines thereof.

DETAILED DESCRIPTION OF THE INVENTION

Figure 1:
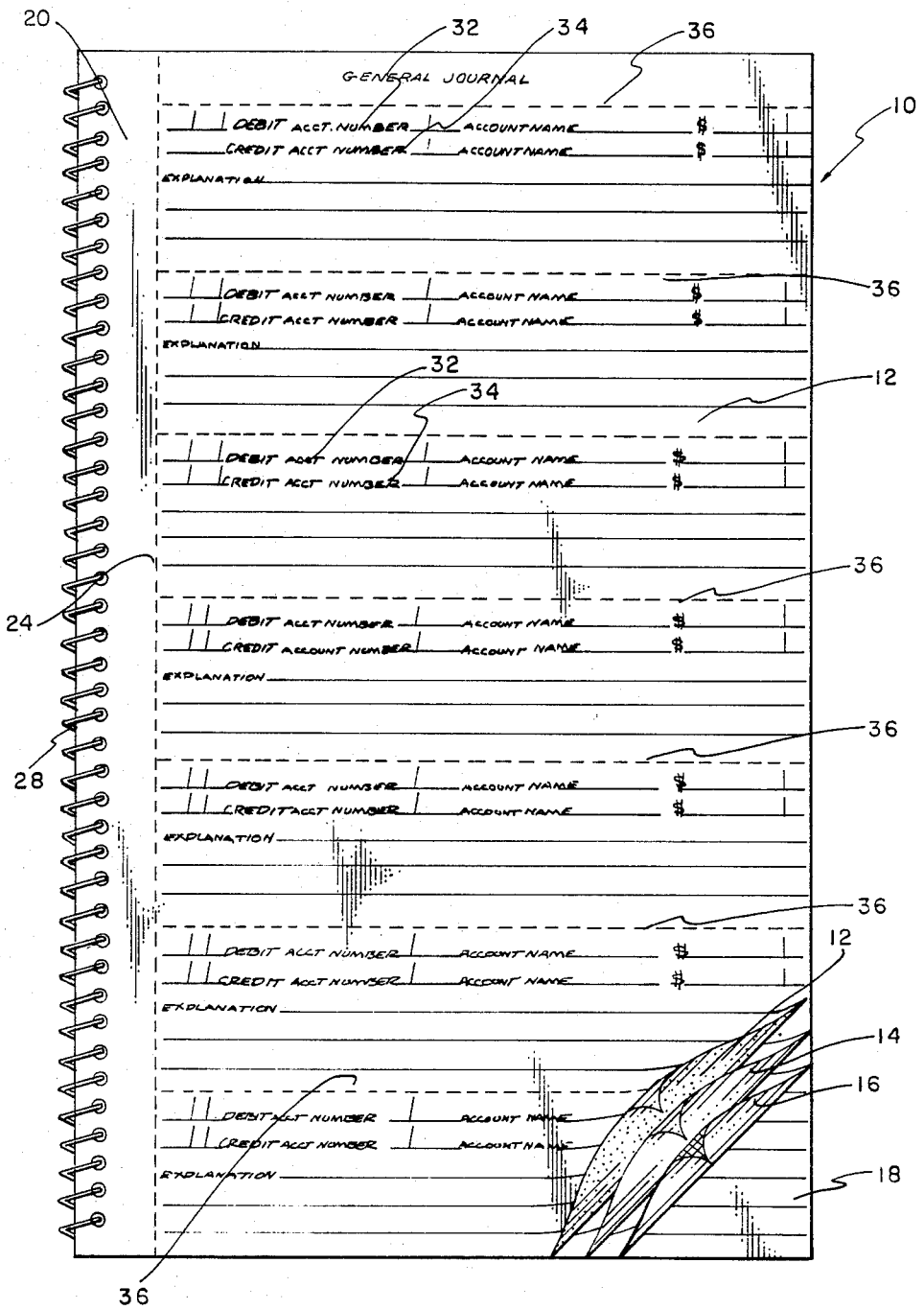
FIG. 1 is a top plan view of the general journal form.

Referring in detail now to the drawings, wherein similar parts of the invention are identified by like reference numerals, there is seen the general journal form, generally illustrated as 10, including, in combination, a top record leaf 12, a pressure sensitive leaf 14, a transfer means or carbon leaf 16, and a back record leaf 18, in order stated. Top record leaf 12 and back record leaf 18 each respectfully has a top leaf border member 20 and a back leaf border member 22 respectfully attached to each by a vertical top record leaf perforate line 24 and a vertical back record leaf perforate line 26. Self-contained leaf 14 and carbon leaf 16 may also respectfully include a pressure sensitive border member (not shown in the drawings) and a carbon leaf border member (not shown in the drawings) respectfully secured to each leaf 14, 16 by a vertical pressure sensitive perforate line (not shown in the drawings) and a vertical carbon leaf perforate line (not shown in the drawings). A spiral binder 28 attaches to the leaves 12, 14, 16 and 18 of the general journal form 10, or to the border members (see FIG. 1) thereof, for binding a plurality of the general journal forms 10 in an overlying relationship as pages of a book. In an alternative embodiment of the invention, apertures 30 may be situated through and at the top of the leaves 12, 14, 16 and 18 of the general journal form 10 or through the border members (see FIG. 5 and 6) for placing a plurality of the forms 10 in a binder (not shown in the drawings).

Figure 2:
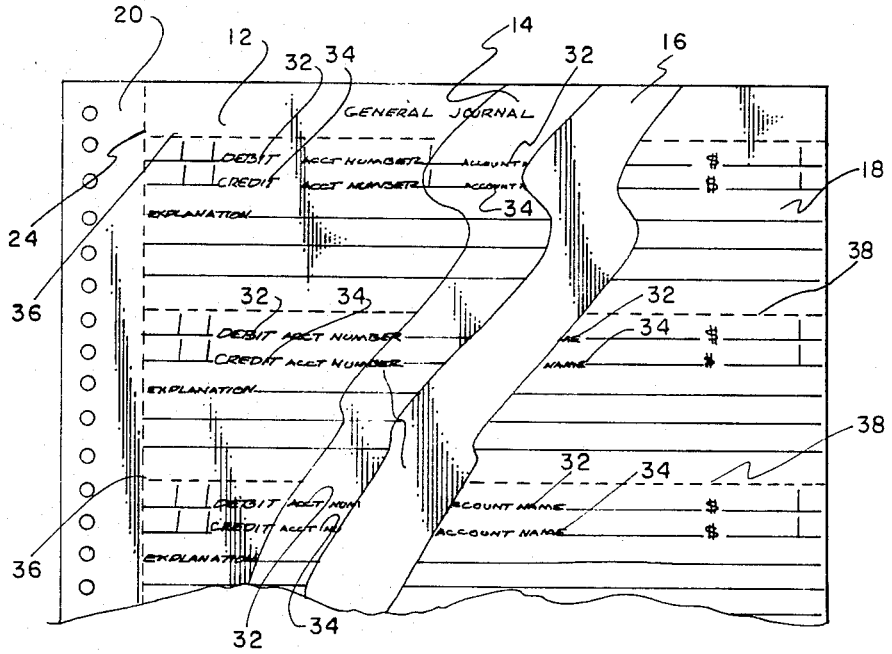
FIG. 2 is a partial top plan view of the general journal form disclosing the top record leaf, the pressure sensitive leaf, the carbon leaf, and the back record leaf.

The top record leaf 12, the pressure sensitive leaf 14, and the back record leaf 18 have identical printed matter, such as debit indicia 32 and credit indicia 34, and lines in overlying registry (see FIGS. 1 and 2) for record keeping. The identical printed matter and the lines extend transversely across each of the leaves 12, 14, and 18 and are repeated on each leaf 12, 14 and 18, at equally spaced intervals a plurality of times from the upper to the lower portion of each of the three leaves 12, 14 and 18 (see FIGS. 1 and 2).

Figure 3:
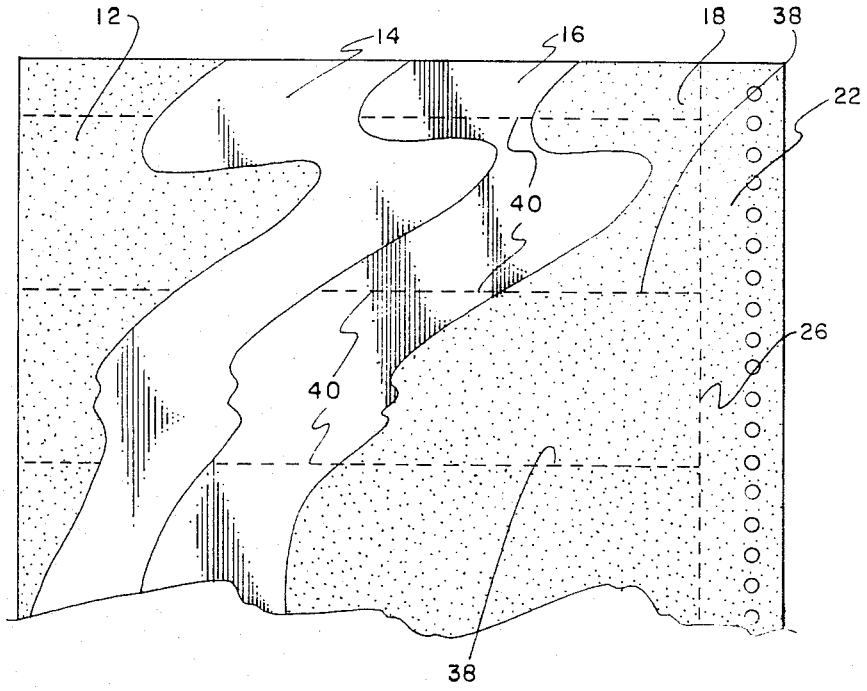
FIG. 3 is a partial bottom plan view of the invention of FIG. 2 disclosing the four leaves of FIG. 2.

The top record leaf 12 and the back record leaf 18 perferably include respectfully parallel rows of perforations 36 and 38 which extend transversely across the entire width of the leaves 12 and 18 (see FIGS. 1 and 3) contiguous to the upper extremities of the equally spaced repetitive printed matter and lines on each of the leaves 12 and 18. In a preferred embodiment of the invention, the carbon leaf 16 also has parallel rows of perforations 40 (see FIG. 3) which also extend transversely across the entire width of the carbon leaf 16 and overlies in registry with the parallel rows of perforations 36 and 38 of the top record leaf 12 and the back record leaf 18. Also in a preferred embodiment of the invention, the top record leaf 12 and the back record leaf 18 each include an adhesive means on the backs thereof such that when moistened the backs of the leaves 12 and 18 will adhere to a desired surface.

With continuing reference to the drawings for operation of the invention, my new general journal form 10 provides with one writing a general journal entry debit, and a general journal credit for use in double entry bookkeeping. In double entry bookkeeping each recorded transaction requires the writing of an amount as a debit to an account, and in writing the same amount as a credit to another account. The amount debited must equal the amount credited. Transactions are usually entered in a journal first. The date, the name of the account to be debited and the amount to be debited is written in the debit column. The name of the account to be credited is written, and the amount to be credited is written in the credit column. The amount written in each column must be exactly the same. A brief explanation of the transaction is then written. The accounts should be numbered to permit indexing and also for use as a posting reference.

When posting is done manually, entries in the journal are transferred to an account in the ledger. This is done by writing each amount in the debit side of an account in the ledger corresponding to the account debited in the journal, and by writing each amount in the credit column in the journal on the credit side of a corresponding account in the ledger. The account to which each item is to be posted is determined by the account title and number in the journal. The number of the journal page from which the posting is made is recorded in the posting reference column of the ledger account. The number of the ledger account to which the posting is made is recorded in the posting reference column in the journal. This completes the cross reference between the journal and the ledger.

By utilization of my invention, the account number to be debited and the amount are written on the debit indicia line 32. The account number and the name of the account to be credited are written on the credit indicia line 34. The explanation is written in the "explanation" space below the credit indicia line 34. The original strip from the stop record leaf 12 is detached along perforate lines 36 and 24 (see FIG. 7), and moistened along the back bottom edge and posted on a ledger account as a debit. The duplicate of the original strip is detached from the back record leaf 18 (see FIG. 3), and also moistened along the back bottom edge thereof and posted on a ledger account as a credit. The carbon leaf 16 may be detached in the appropriate place and thrown away. The pressure sensitive leaf 14 with the same identical debit, credit and explanation information as written on the strips of the top record leaf 12 and the back record leaf 18 may be turned under the back of the pad and kept in the books as disclosed in my copending patent application having Ser. No. 458,575 and filed 3/9/83, now U.S. Pat. No. 4,502,712, issued 3/5/85 or it may be detached and filed in a ring binder through use of apertures 30. Thus, by use of my invention, the equality of the debits and credits and the cross reference between the ledger and journal are achieved with only one writing.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A general journal form comprising, in combination, a top record leaf;

a pressure sensitive self-contained leaf;

transfer means;

and a back record leaf, all bound together as pages of a book in order stated at a common border;

said top record leaf, said pressure sensitive self contained leaf, and said back record leaf all having identical printed matter and lines in overlying registry for record keeping extending transversely across each;

said identical printed matter and lines being repeated on said top record leaf, said pressure sensitive self contained leaf and said back record leaf at equally spaced intervals a plurality of times from the upper to the lower portion or each of the three leaves;

and parallel rows of perforations extending transversely across the entire width of said top record leaf and said back record leaf contiguous to the upper extremities of each of said equally spaced repetitive printed matter on said top record leaf and on said back record leaf to provide for detachable sections of said top and said back leaf;

said parallel rows of perforations on said top record leaf and on said back record leaf are in overlying registry;

said top record leaf and said back record leaf each include adhesive means on the back thereof such that when moistened the backs will adhere to a desired surface;

said transfer means is a carbon leaf, said carbon leaf having parallel rows of perforations extending transversely across the entire width of the carbon leaf which overly in registry with the parallel rows of perforations of the top record leaf and the back record leaf;

a binding means for binding a plurality of said general journal form in an overlying relationship as pages of a book;

said top record leaf, said pressure sensitive self contained leaf and said back record leaf each include debit indicia and credit indicia;

said top record leaf and said record leaf additionally respectfully comprises a top record leaf border member and a back record leaf border member respectfully secured to each leaf by a vertical top record leaf perforate line and a vertical back record leaf perforate line;

said pressure sensitive self contained leaf and said carbon leaf also respectfully comprises a pressure sensitive self contained border member and a carbon leaf border member respectfully secured to said pressure sensitive self contained leaf and carbon leaf by a vertical pressure sensitive self contained perforate line and a vertical carbon leaf perforate line.

* * * * *